United States Patent [19]

Borick et al.

[11] Patent Number: 4,815,610

[45] Date of Patent: Mar. 28, 1989

[54] LUG NUT DISPLAY APPARATUS AND METHOD OF PRODUCT SELECTION

[75] Inventors: Avron W. Borick, Woodland Hills; Ronald F. Escue, La Canada, both of Calif.

[73] Assignee: Superior Industries International, Inc., Van Nuys, Calif.

[21] Appl. No.: 80,901

[22] Filed: Aug. 3, 1987

[51] Int. Cl.[4] ..... A47F 7/00

[52] U.S. Cl. ..... 211/59.1; 211/13; 206/459

[58] Field of Search ..... 211/59.1, 57.1, 13; 206/459; 40/1, 534, 584

[56] References Cited

U.S. PATENT DOCUMENTS

| | | | |
|---|---|---|---|
| 3,040,448 | 6/1962 | Paxton | 211/13 X |
| 3,070,235 | 12/1962 | Manzardo | 211/13 |
| 3,804,238 | 4/1974 | Howard | 206/459 |
| 4,195,059 | 3/1980 | Whitcher | 206/459 X |
| 4,328,884 | 4/1983 | Anderson | 211/59.1 X |

OTHER PUBLICATIONS

Brochure for "The Wheel Doctor", Four Pages, Apr. 1984, Mensa Automotive Products.

*Primary Examiner*—Robert W. Gibson, Jr.
*Attorney, Agent, or Firm*—Fulwider, Patton, Rieber, Lee & Utecht

[57] ABSTRACT

A lug nut display apparatus and method of product selection having a triangular heavy wire gauge construction, for supporting a plurality of sizing studs which penetrate a color-coded application and identification chart, cooperates with a plurality of lug nut container boxes suspended from a plurality of adjustable lozier pegs for significantly increasing the display capacity of automotive lug nuts for maximum utilization of retail floor space, the application and identification chart having a directory for identifying a color assigned to a particular listed vehicle for identifying and verifying on the sizing studs the actual wheel stud size, with the color code being employed to select the correct replacement or stylized lug nut based upon thread size, wheel style, and material of construction.

25 Claims, 2 Drawing Sheets

FIG. 1
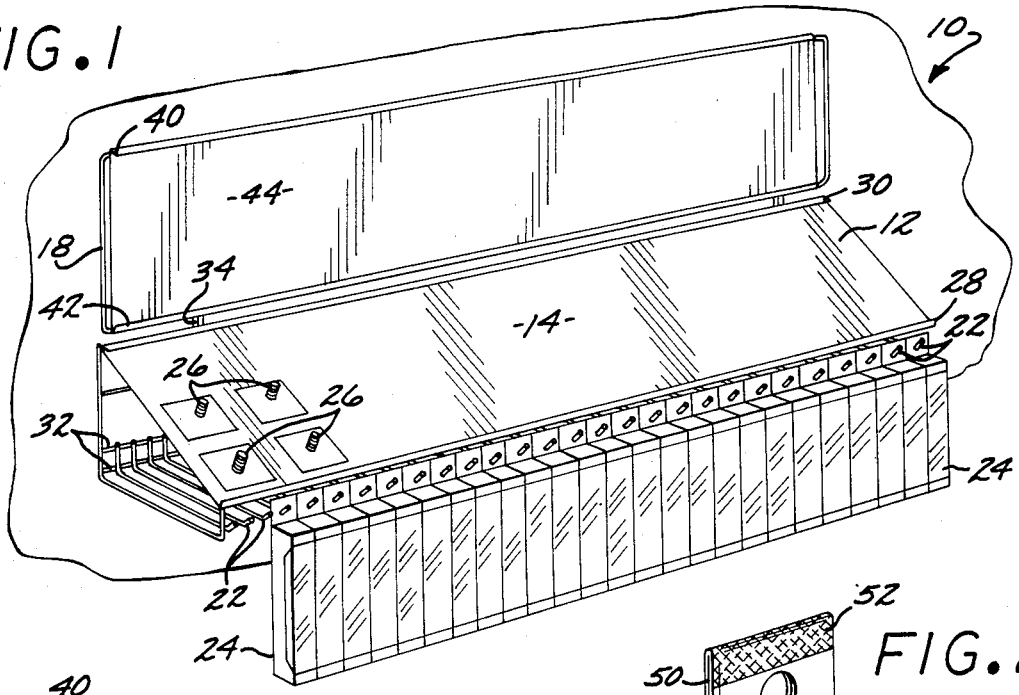
FIG. 2
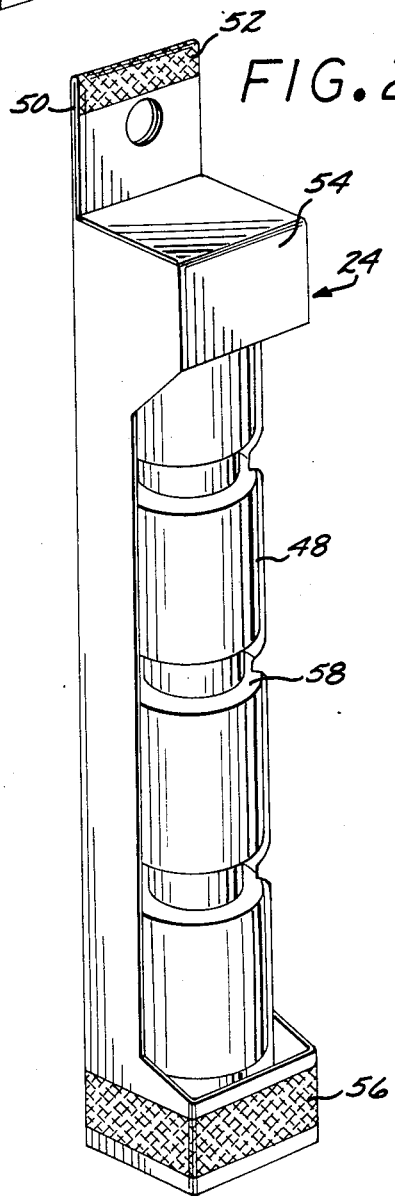
FIG. 3
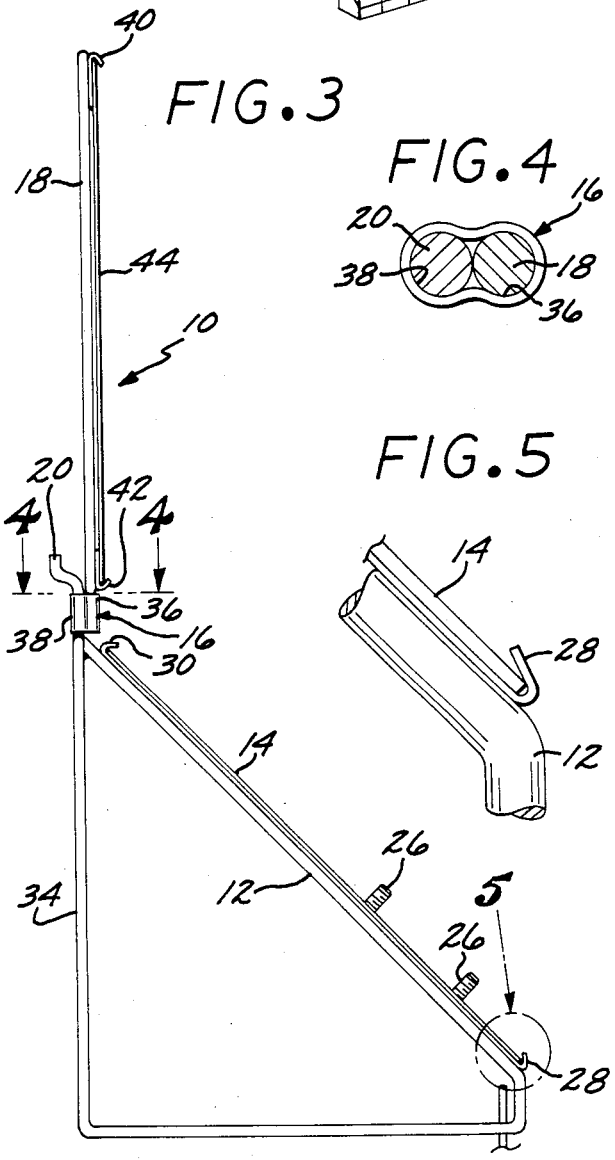
FIG. 4
FIG. 5

LUG NUT DISPLAY APPARATUS AND METHOD OF PRODUCT SELECTION

BACKGROUND OF THE INVENTION

This invention relates generally to display systems for use in retail stores, and more particularly to a new and improved heavy-duty display apparatus and method of product selection of the type having integral hooks for supporting a plurality of automotive supply products with the display apparatus being pegboard mounted and having an application chart for assisting in product selection.

In the field of automotive retail display systems, the display apparatus and method should prominently display a high capacity of automotive supply products in the minimum of floor space, and the method of product selection should be convenient. In the past, display systems for automotive products included a plurality of free-standing or pegboard mounted structures for supporting packages of automotive products in a blister card. A blister card or bubble pack is a preprinted card of random size having a thermally formed rigid liner shell sealed by lamination to the blister card with the automotive product captured inside.

The blister card liner shell was generally thermally formed to create separate transparent pockets for encapsulating each of a plurality of automotive supply products. The liner shell was comprised of a transparent film, for example, polyvinyl chloride (PVC) of the appropriate thickness for holding the individual product to the blister card. Further, a hole was punched in a reinforced portion of the blister card for the purpose of hanging the card and its contents from an appropriate suspension device associated with the display rack.

Another method employed in the past for displaying a consumer product included the use of a printed polyethylene bag. The automotive supply product was generally displayed in the polyethylene bag which included a plurality of graphics for identifying the manufacturer, the stock number, and other relevant information. The polyethylene bag was heat sealed much like the blister card and further included a reinforced section in the thermal sealed area of the bag. The reinforced section included a punched hole for hanging the bag from an appropriate suspension device associated with the display rack.

Of the many automotive supply products available in retail sales outlets, the road wheel lug nut is an example of one product commonly sold by the blister card or polyethylene bag method. A consumer who wished to purchase replacement lug nuts for the wheel of an automobile was required to be familiar with the make, model, and year of the automobile, in addition to the thread size of the wheel studs. Once the consumer had mustered this information, it was necessary to search through the inventory of an automotive retail outlet to find the proper size lug nut.

A plurality of customized and stylized automobile wheel rims are currently available for mounting on passenger vehicles. In conjunction with the specialized wheels, consumers often wish to fit the wheel studs with one of a plurality of specialized sets of lug nuts to match the stylized wheel. An example of a stylized lug nut is one that has been brilliantly chromed or more commonly one that is fitted with a personalized locking device. Another example of a stylized lug nut is one in which a special wrench or adapter device is required for the removal and installation of the lug nut, the adapter device being one not commonly available to the consuming public.

There is a long-felt need in the automotive supply parts industry for an automotive retail display apparatus and method of product selection which prominently displays a high capacity of product in the minimum of floor space and includes a selection method in which a consumer can readily identify the make, model, and year of an automobile and the thread size of the wheel studs associated therewith.

With this information, the method should direct the consumer to a particular section of the lug nut inventory which will permit the consumer to conveniently select the proper set of stylized or replacement lug nuts which are packaged in such a way as to be easily identifiable when the selection method is employed.

Hence, those concerned with the development and use of retail display systems in the automotive supply parts industry have long recognized the need for an improved retail display system which will enable a more accurate and convenient selection of the proper size of lug nuts for the wheel of an automobile. The present invention fulfills all of these needs.

SUMMARY OF THE INVENTION

Briefly, and in general terms, the present invention provides a new and improved retail display apparatus and method of product selection which substantially simplifies the consumer process of selecting replacement or stylized lug nuts for automotive road wheels and which significantly increases the display capacity of automotive lug nuts in a minimum of floor space. Moreover, the display apparatus construction of the present invention is collapsible, lightweight and rugged, provides maximum consumer convenience, is adjustable for smaller product lines, and combines the blister board and folding carton packaging techniques.

Basically, the present invention is directed to an improved lug nut display apparatus and method of product selection for simplifying the consumer process of selecting replacement or stylized lug nuts for automotive road wheels. This is accomplished by combining a color-coded application and identification chart with a pegboard mounted retail display apparatus for identifying the make, model, and year of a vehicle and the vehicle wheel stud thread size for selecting the proper lug nut package which is linked to the application and identification chart by the color code.

In accordance with the invention, the lug nut display apparatus is comprised of a triangular structure having a planar lattice surface at approximately forty-five degrees to the vertical, and a figure eight coil fitting which receives and supports a vertically mounted card holder, the display apparatus having a plurality of pegboard hooks located on a rearward side thereof. The forty-five degree planar lattice surface includes a plurality of sizing studs affixed thereto for mounting a color-coded application and identification chart thereon which assists in the selection of the proper size of lug nuts. A rearward support bar includes a plurality of adjustable lozier pegs for mounting a plurality of prepackaged lug nuts therefrom.

In accordance with the improved method of product selection of the present invention, the make, model, and year of the vehicle for which lug nuts are to be selected, is located on the color-coded application and identification chart. Once the vehicle is identified on the chart, the color of a dot associated with the make, model, and year of the vehicle is noted. The color of the dot is coded to a second section of the chart for identifying the thread size of the vehicle wheel studs.

The plurality of sizing studs of the display apparatus protrude upward through the application and identification chart permitting an actual lug nut from the vehicle road wheel to be verified in size. Once the size of the lug nut is verified, the color associated with the vehicle from the first and second sections of the chart is transferred to a third section of the chart having a color bar thereon. Once the style of wheel fitted on the vehicle is identified, a prepackaged set of lug nuts may be selected having a color code matched to the color code of the first, second, and third sections of the chart.

The new and improved lug nut display apparatus and method of product selection substantially simplifies the consumer process of selecting replacement or stylized lug nuts for automotive road wheels and significantly increases the display capacity of automotive lug nuts in a minimum of display space. Further, the display apparatus construction is collapsible, lightweight and rugged, provides maximum consumer convenience, is adjustable for smaller product lines and combines the blister board and folding carton packaging techniques.

These and other features and advantages of the invention will become apparent from the following more detailed description, when taken in conjunction with the accompanying drawings, which illustrate, by way of example, the features of the invention.

BRIEF DESCRIPTION OF THE DRAWINGS

FIG. 1 is a perspective view of a lug nut display apparatus in accordance with the present invention;

FIG. 2 is a perspective view of a prepackaged, color coded set of lug nuts employed in conjunction with the lug nut display apparatus of FIG. 1.

FIG. 3 is a side elevational view of the lug nut display apparatus of FIG. 1;

FIG. 4 is a cross-sectional view of a coil fitting of the lug nut display apparatus taken along the line 4—4 of F 3;

FIG. 5 is an enlarged, partial, detailed view of the application and identification chart securing device of the lug nut display apparatus of FIG. 3;

DESCRIPTION OF THE PREFERRED EMBODIMENT

Figure 7:
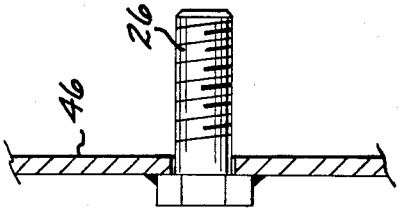
FIG. 7 is a cross-sectional view of a sizing stud of the lug nut display apparatus taken along the line 7—7 of FIG. 6.

As shown in the drawings for purposes of illustration, the invention is embodied in a lug nut display apparatus 10 and method of product selection of the type having a triangular construction including a planar lattice surface 12 for mounting an application and identification chart 14 thereon and a figure eight coil fitting 16 for supporting a vertically mounted card holder 18 and a plurality of mounting hooks 20 for connection to a pegboard support system (not shown) with the display apparatus 10 carrying a plurality of adjustable lozier pegs 22 for suspending a plurality of lug nut container boxes 24 therefrom. The method of product selection employes the chart 14 for identifying the correct thread size of the vehicle wheel studs for accurately selecting the proper size of lug nuts.

A display system of the past for automotive products such as lug nuts included a plurality of free-standing or pegboard mounted structures with the packaged products mounted on a blister board or a bubble pack which is a preprinted card of random size having a thermally formed rigid liner shell sealed by lamination to the card. The line shell generally included transparent pockets for encapsulating each of the plurality of automotive products and was comprised of a transparent film such as polyvinyl chloride (PVC) of the appropriate thickness for holding the individual product to the blister card.

A second method employed in the past for displaying the road wheel lug nuts included the printed polyethylene bag which included a plurality of illustrative graphics on the bag for identifying the manufacturer, the stock number, and other relevant information. The bag was heat sealed and included a reinforced section in the thermal sealed area of the bag. Both the blister card and the polyethylene bag included a punched hole in a reinforced section of the card or bag for hanging from an appropriate suspension device associated with the display system.

A consumer who wished to purchase replacement or stylized lug nuts for a vehicle wheel was required to know the make, model, and year of the automobile in addition to the thread size of the wheel studs. There has been a long-felt need in the automotive supply parts industry for an automotive retail display apparatus and method of product selection which prominently displays a high capacity of product in the minimum of display space and which includes a selection method in which a consumer can readily identify the make, model, and year of an automobile and the thread size of the wheel studs associated therewith. The method should then direct the consumer to a particular section of the lug nut inventory which will premit convenient selection of the proper set of stylized or replacement lug nuts which are packaged for easy identification.

In accordance with the present invention, the color-coded application and identification chart 14 and a plurality of sizing studs 26 cooperate with the color-coded lug nut container boxes 24 suspended from the plurality of adjustable lozier pegs 22 to substantially simplify the consumer process of selecting replacement or stylized lug nuts for automotive road wheels and to significantly increase the display capacity of automotive lug nuts in a minimum of floor space. Further, the display apparatus 10 is collapsible, lightweight and rugged, provides maximum consumer convenience, is adjustable for smaller product lines and combines the blister card and folding carton packaging techniques for improved results.

The application and identification chart 14 is rectangular in shape and includes a plurality of four holes for accommodating the plurality of sizing studs 26. The chart is physically laid across the planar lattice surface 12 and aligned with the four sizing studs employed for verifying the size of an actual lug nut from the vehicle wheel. The chart is then adjusted to slide into a lower trough 28 and an upper trough 30 with the lower and upper troughs each respectively running along the lower and upper horizontal lengths of the planar lattice surface 12, as shown in FIGS. 1 and 3.

The display apparatus 10 is comprised of a heavy-gauge wire which is of sufficiently rugged construction to support the plurality of lug nut container boxes 24 suspended on the plurality of adjustable lozier pegs 22. Each of the container boxes may contain four lug nuts, an adapter device, and four washers and weighs between three-quarters of a pound and one and one-quarter of a pound. In the display condition, the load suspended from the display apparatus 10 is within the range of one hundred fifty to two hundred pounds.

The plurality of lozier pegs 22 are mounted to and supported by a plurality of rearward support bars 32 which are also comprised of heavy-gauge wire and run the horizontal length of and are integrally connected to the display apparatus 10. The lozier pegs 22 are affixed to the rearward support bars 32 as, for example, by welding.

Along the horizontal length of the planar lattice surface 12 is a plurality of the figure eight coil fittings 16 best shown in FIGS. 1, 3, and 4. The coil fittings 16 are comprised of the heavy-gauge wire and are mounted atop a pair of back vertical supports 34 which are orthogonal to a base of the display apparatus 10. The coil fittings 16 are figure eight in shape and contain two circular chambers which are open one unto the other. A forward chamber 36 accommodates the vertical mounted card holder 18, while a rearward chamber 38 accommodates one of the plurality of mounting hooks 20.

The vertically mounted card holder 18 further includes an upper gutter 40 and a lower gutter 42 for retaining a vertical place card 44 in the card holder 18. The plurality of mounting hooks 20 are an integral part of the display apparatus 10 with at least two hooks being direct extensions of the back vertical support 34. During the assembly of the display apparatus 10, the mounting hooks 20, which are upwardly extending hooks (shown best in FIG. 3), are each inserted into one of a plurality of hook receptacles on a pegboard rack for supporting the entire display apparatus 10.

The rectangular portion of the display apparatus 10 is mounted on the pegboard rack prior to the installation of the vertically mounted card holder 18 or the plurality of container boxes 24. There are approximately six to eight mounting hooks 20 integrally connected to the display apparatus at the back vertical supports 34 or on the vertical members of the planar lattice surface 12, depending upon the size of the display apparatus and the anticipated load of the product to be displayed. Once the display apparatus is mounted to the pegboard (not shown), the vertically mounted card holder 18 is slipped into the forward chamber 36 of the coil fitting 16.

At least two of the coil fittings 16 are required to support the card holder 18. The mounting hook 20 received by the rearward chamber 38 of the coil fitting 16 actually provides the support for the card holder 18. Although the plurality of mounting hooks 20 illustrated in FIGS. 1 and 3 are the preferred method for mounting the display apparatus 10 on the pegboard rack, an alternative method would permit the elimination of the plurality of mounting hooks and the welding of the display apparatus and the associated lozier pegs 22 directly to a plurality of vertical stanchions (not shown).

Figure 6:
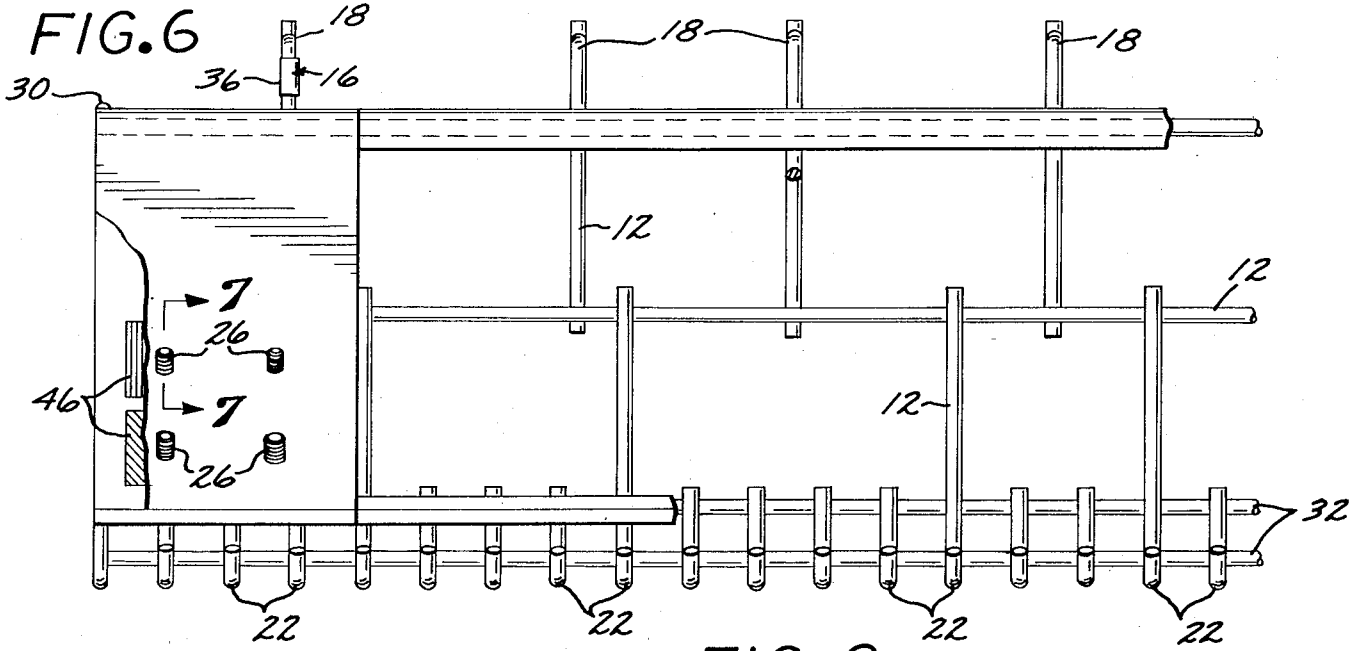
FIG. 6 is a front elevational view, partly in cut-away section, illustrating the structural members of the lug nut display apparatus of FIG. 1.

When the application and identification chart 14 is removed, the heavy-gauge wire construction of the planar lattice surface 12 is visible, as shown in FIG. 6. Each of the lozier pegs 22 are shown connected to the rearward support bars 32 while the lower and upper troughs 28, 30 which support the application and identification chart 14 are visible. The plurality of sizing studs 26 are illustrated with a portion of the lattice surface 12 being cut away.

Located beneath the lattice surface 12 and behind the sizing studs 26 is a pair of backing plates 46 welded to the wire frame of the lattice surface 12. Each of the plurality of sizing studs 26 are in turn welded to one of the pair of backing plates 46 for supporting the sizing studs. The sizing studs are thus fixedly held in an orthogonal position relative to the backing plates 46 providing the sizing studs with substantial rigidity for sustaining the load applied during thread size testing by installing and removing vehicle wheel lug nuts. The head of the sizing stud 26 is shown tack welded to the backing plate 46 in FIG. 7.

The design of the instant display apparatus 10 permits a retailer to provide a high quantity of inventory on display in a small area of the retail outlet. It is critical for the small retailer to increase the sales capacity per square foot of his retail outlet and the display apparatus of the instant invention permits the retailer to accomplish this goal.

Further, the display apparatus is collapsible as the vertically mounted card holder 18 is easily removed from the coil fitting 16 and the plurality of container boxes 24 may be removed from the lozier pegs 22 so that the triangular portion of the display apparatus may be removed from the pegboard rack. Since a heavy-gauge wire is used for the construction, the display apparatus is lightweight but is of sufficient rugged construction to support the card holder 18 and the plurality of container boxes 24. Also, the display apparatus 10 may be made to be adjustable for accommodating a smaller product line.

Each of the lug nut container boxes 24 is comprised of an elongated box for displaying a plurality of four lug nuts 48. The upper end of the container box is formed with an apertured tab 50 which is placed over one of the lozier pegs 22 located on the front of the display apparatus 10. The boxes 24 are color coded in silver for magnesium or aluminum lug nuts or in black for steel lug nuts. Additionally, the boxes have color trim ornamentation which designates the size of the wheel stud for which the lug nut was designed. An example of the color code which reflects the size of the thread measurement is 7/16 inch×20 thread pitch is indicated by red trim, ½ inch×20 thread pitch is designated by orange trim, 12 mm×1.25 mm thread pitch is designated by green trim, and 12 mm×1.50 mm thread pitch is designated by blue trim. A color portion 52 of the apertured tab 50 designates the thread size of the enclosed lug nuts.

Each of the boxes 24 includes a front upper panel 54 which is marked with the designation "LOCKING" plus a stock number or, in the alternative, the word "STANDARD" plus a stock number. The front upper panel 54 may also bear indicia such as the words "DIRECT BOLT," "SUPERLUG," or "MULTI-FIT." A front lower panel 56 of the container boxes 24 includes a color-coding stripe wrapped about the entire container box which matches the color of that on the color portion 52 of the tab 50.

The container box 24 is a folding carton type of box which may be opened from either the top or the bottom. Further, within the folding container box 24 is a molded form 58 comprised of a thermally formed rigid liner shell which is transparent and custom formed for the plurality of lug nuts 48. The molded form 58 is hemispheric in shape with an open bottom and comprising six compartments. One of the compartments houses four washers, while a second of the compartments houses a specialized adapter device for installing and removing the lug nuts 48 preventing theft of the wheel. The remaining four compartments are shaped to accommodate one of the four lug nuts.

The container box 24 is enclosed at least partially on three sides but open at the front with the transparent molded form 58 being exposed at the open front for advertising the product. Once the washers, the lug nuts, and the special adapter device have been inserted into the molded form, the molded form is slid sideways into one of the two openings of the elongated container box 24 which is then folded into its closed position and suspended from one of the lozier pegs 22 on the display apparatus 10.

Figure 8:
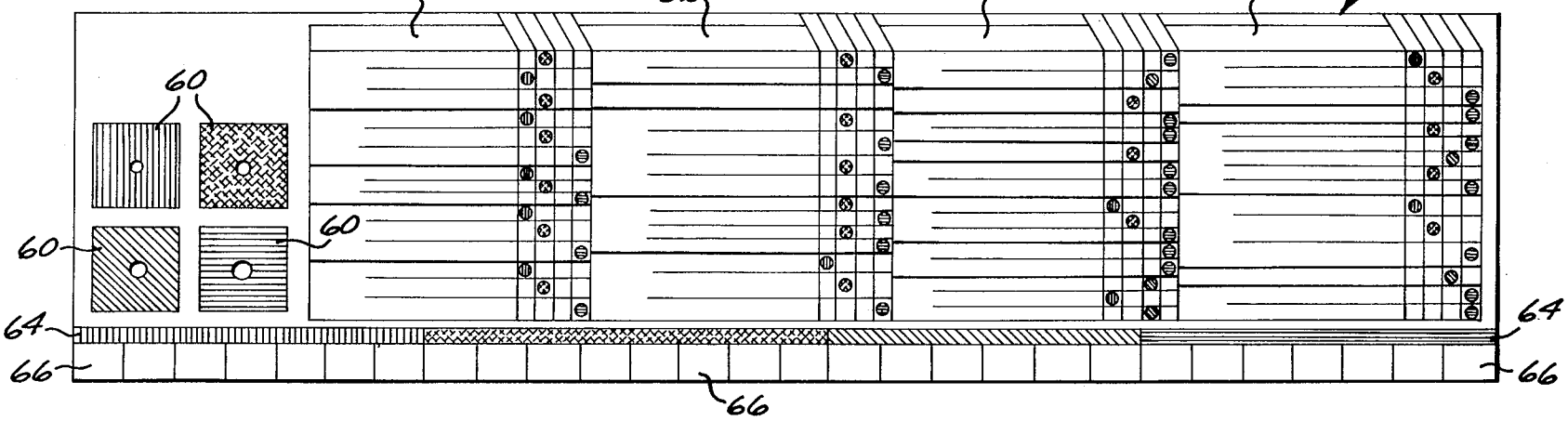
FIG. 8 is a front elevational view of the application and identification chart of the lug nut display apparatus of FIG. 1.

The vertical place card 44 mounted in the card holder 18 may measure, for example, ($9'' \times 35\frac{3}{4}''$) and bear a description of the lug nuts and the color coding of the boxes. The application and identification chart 14 may measure, for example, ($9\frac{1}{2}'' \times 35\frac{3}{4}''$). Each of the sizing studs 26 is surrounded by a colored square 60 for identifying the thread size of the sizing stud extending therefrom as shown in FIG. 8. The chart 14 is also provided with a directory 62 which recites the make, model, and year of each of the vehicles for which lug nuts 48 are provided. If the vehicle for which lug nuts are to be purchased is listed and described in the directory 62, a colored dot will appear to the right of that listing in the directory 62. The color of the dot is coded to the colored square 60 surrounding one of the sizing studs 26.

At this time, it is advisable to verify the thread size of the vehicle wheel stud by removing one of the actual lug nuts located on the vehicle wheel stud. Then, the actual vehicle wheel lug nut is threaded onto the sizing stud indicated by the colored dot in the directory 62. If the actual lug nut from the vehicle may be installed on and removed from the indicated sizing stud 26, the proper thread size has been selected. However, if the vehicle lug nut cannot be easily installed and removed from the sizing stud, then the vehicle lug nut should be installed on and removed from the remaining three sizing studs to determine the proper size of the vehicle wheel stud thread.

Located on the application and identification chart 14 beneath the sizing studs 26 and the directory 62 is a multi-colored bar 64 which is color coded in red, orange, green, and blue to match the color code of the colored squares 60 and the colored dots in the directory 62. Beneath the color bar 64 is a plurality of vertical columns 66 which carry designations indicating the material of which the lug nut is comprised.

Once the thread size of the actual lug nut from the vehicle wheel stud is verified, the color associated with the proper sizing stud 26 is located on the color bar 64. Upon determining the style and the material of construction of the vehicle wheel, the proper vertical column of the plurality of vertical columns 66 may be selected. The proper vertical column identifies the correct container box 24 housing the lug nuts 48 which will properly fit the vehicle wheel studs.

The plurality of lozier pegs 22 are distributed across the front of the application and identification chart 14 so that one of said lozier pegs is aligned beneath each of said vertical columns 66. Each of the lug nut container boxes 24 having the proper color coding and identification indicia may be mounted onto the proper lozier peg for retail display and sale.

By employing the above-described selection method associated with the display apparatus 10, the customer enjoys maximum convenience in that the process of selecting the correct lug nuts is simplified. Further, by combining the two media of the molded form 58 with the folding container box 24, a visual package is created which increases the product exposure.

From the foregoing, it will be appreciated that the display apparatus and method of product selection of the invention substantially simplifies the consumer process of selecting replacement or stylized lug nuts for automotive road wheels and which significantly increases the display capacity of lug nuts for maximum utilization of retail floor space. Further, the display apparatus construction of the present invention is collapsible, lightweight and rugged, provides maximum consumer convenience, is adjustable for smaller product lines and combines the blister molded form and folding carton packaging techniques for greater product exposure.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A lug nut display apparatus comprising, in combination:

a metal frame support having a semi-vertical planar surface;

a plurality of threaded studs extending orthogonally from said planar surface for use in sizing a plurality of vehicle lug nuts;

an application chart mounted on said metal support frame for providing instructions in the selection of said lug nuts;

a pair of channels located along a top and a bottom longitudinal border of said planar surface for retaining the position of said application chart;

a plurality of support hooks extending from said metal frame support for supporting a plurality of container boxes, said container boxes being elongated and containing a plurality of lug nuts visible through the front of each of said container boxes; and a plurality of mounting hooks integrally connected to said metal frame support for mounting said metal frame support to a stable surface.

2. The display device of claim 1 wherein said metal frame support is comprised of a heavy-gauge wire.

3. The display device of claim 1 wherein said metal frame support further includes a plurality of figure eight coil fittings comprised of a heavy-gauge wire.

4. The display device of claim 3 wherein each of said figure eight coil fittings are comprised of a forward chamber for receiving and supporting a vertically mounted card holder and a rearward chamber for clamping about a back vertical support of said metal frame support for securing said figure eight coil fitting in place.

5. The display device of claim 3 further including a vertically mounted card holder having a plurality of vertical mounting stands with each mounting stand secured within a forward chamber of one of said figure eight coil fittings.

6. The display device of claim 1 further including a vertically mounted cardholder having an upper gutter and a lower gutter formed along the horizontal borders of said card holder for retaining a place card.

7. The display device of claim 1 wherein said semi-vertical planar surface includes a planar lattice surface comprised of a heavy-gauge wire.

8. The display device of claim 7 wherein said planar lattice surface further includes a plurality of rearward support bars for providing structural support to said plurality of support hooks, said rearward support bars comprised of a heavy-gauge wire.

9. The display device of claim 1 wherein said plurality of support hooks is comprised of a plurality of horizontally suspended pegs.

10. The display device of claim 1 wherein said metal frame support comprises a triangular structure.

11. The display device of claim 10 wherein said triangular structure comprises a back vertical support, said back vertical support being orthogonal to a base portion of said support means.

12. The display device of claim 1 wherein said plurality of threaded studs is mounted in a planar lattice surface of said semi-vertical planar surface, said planar lattice surface further including a pair of backing plates affixed to said planar lattice surface.

13. The display device of claim 12 wherein said plurality of threaded studs are further tack welded to said pair of backing plates for securing said threaded studs.

14. An application and identification chart for utilization on a lug nut display apparatus comprising, in combination:

a color-coded chart;

a plurality of penetrations through, said chart for accommodating a plurality of display apparatus sizing studs penetrating said chart, each of said penetrations having a color-coded square about said penetration;

an information directory located adjacent to said plurality of penetrations for assisting in identifying a vehicle and determining a lug nut thread size for said vehicle, said lug nut thread size being identified by a colored dot, said colored dot being coded to one of said color-coded squares;

a color bar coded to and located beneath said plurality of color-coded squares and said information directory for designating the thread size of each of a plurality of lug nuts; and a plurality of vertical columns extending from said color bar, said vertical columns for identifying the material of said lug nuts housed in a plurality of container boxes suspended from said display apparatus.

15. The application and identification chart of claim 14 wherein said chart is rectangular in shape and comprised of flexible material.

16. The application and identification chart of claim 14 wherein said chart is comprised of paper.

17. The application and identification chart of claim 14 wherein said chart is comprised of plastic.

18. A method of assembling a lug nut display apparatus, said method comprising the steps of:

hanging said display apparatus on an external support at the desired level for securing said display apparatus;

placing a bottom edge and a top edge of an application chart respectively into a bottom channel and a top channel of a planar lattice surface, said bottom and said top channels each running horizontally along a bottom border and a top border of said display apparatus;

aligning said application chart with a plurality of sizing studs mounted on said display apparatus, said sizing studs protruding through said chart;

inserting a vertically mounted card holder into a plurality of figure eight coil fittings on said display apparatus;

snapping a place card into said vertically mounted card holder, said place card for advertising a plurality of lug nuts; and suspending a plurality of lug nut container boxes from said display apparatus.

19. The method of assembling a lug nut display apparatus of claim 18 further including the step of punching a plurality of holes through said application chart for accommodating said plurality of sizing studs.

20. A display device for a plurality of packages of vehicle lug nuts to replace original lug nuts, said display comprising:

support means having a planar surface;

a plurality of threaded studs extending from said planar surface for use in sizing vehicle lug nuts to be replaced by lug nuts contained in said packages;

an application and instruction chart on said planar surface for providing instruction in the selection of lug nuts contained in said packages;

a plurality of horizontal pegs extending from said support means below said planar surface, said pegs removably supporting a plurality of said packages; and mounting means on said support means for mounting said support means to a stable surface.

21. The display device of claim 20 wherein said support means comprises a metal frame support.

22. The display device of claim 20 wherein said planar surface extends downwardly and forwardly from its upper rear edge.

23. The display device of claim 22 wherein said support means comprises a generally triangular wire structure, the upper surface of which defines the planar surface and the lower portion of which is formed with the horizontal pegs.

24. The display device of claim 22 wherein the upper rear portion of the support is provided with a vertically extending card bearing a description of the method of use of the display device.

25. The display device of claim 22 wherein the instruction chart includes:

a color-coded square surrounding each of said threaded studs;

an information directory located adjacent to each of threaded studs for assisting in identifying a vehicle and determining a lug nut thread size for said vehicle, said lug nut thread size being identified by a colored dot, said colored dot being coded to one of said color-coded squares;

a color bar coded to and located beneath said plurality of color-coded squares and said information directory for designating the thread size of each of a plurality of lug nuts; and a plurality of vertical columns extending from said color bar, said vertical columns identifying the material of said lug nuts housed in the lug nut packages suspended from said horizontal pegs.

* * * * *